United States Patent [19]

Hesch

[11] Patent Number: 4,944,234

[45] Date of Patent: Jul. 31, 1990

[54] RAIL CAR END ASSEMBLY

[75] Inventor: Harold E. Hesch, St. John, Ind.

[73] Assignee: Trinity Industries, Inc., Dallas, Tex.

[21] Appl. No.: 352,715

[22] Filed: May 12, 1989

Related U.S. Application Data

[63] Continuation of Ser. No. 65,948, Jun. 24, 1987, abandoned.

[51] Int. Cl.[5] ..... B61D 17/06

[52] U.S. Cl. ..... 105/378; 49/40; 49/449

[58] Field of Search ..... 105/378, 410; 49/40, 49/41, 395, 449; 410/26, 27, 4

[56] References Cited

U.S. PATENT DOCUMENTS

| | | | |
|---|---|---|---|
| 2,232,026 | 2/1941 | Gober | 49/449 X |
| 2,824,339 | 2/1958 | Shaver | 105/378 X |
| 3,181,903 | 5/1965 | Olander | 105/378 |
| 3,827,184 | 8/1974 | Pennec et al. | 49/449 |
| 3,828,693 | 8/1974 | Kampmann et al. | 105/378 |
| 3,995,563 | 12/1976 | Blunden | 105/378 |
| 4,077,330 | 3/1978 | Peisner et al. | 105/378 X |
| 4,084,516 | 4/1978 | Ravani et al. | 105/378 X |
| 4,318,349 | 3/1982 | Galasan | 105/378 |
| 4,437,410 | 3/1984 | Stoller, Sr. et al. | 105/378 |
| 4,649,831 | 3/1987 | Burleson | 105/378 |

*Primary Examiner*—Margaret A. Focarino
*Assistant Examiner*—Dean J. Kramer
*Attorney, Agent, or Firm*—Richard J. Myers

[57] ABSTRACT

A rail car end assembly comprises upper and lower tracks for guiding and stabilizing mutli-panel rigid doors moving between open and closed positions. End posts are located inside the car and spaced inwardly from respective side wall end portions. The doors pass between the space between the end posts and the side wall end portion when moved into the open position. A latch arrangement is provided which latches the door in the open and closed positions. The latch arrangement includes a lower pin engaging a keeper adjacent the lower track, and an upper pin engaging a keeper supported on an elevated platform in the car. The pins are joined by a cable for synchronous movement to lock and to release the doors. Each door has a follower engaging the upper track for guiding the door. In the closed position, the follower engages a stop on the track which reinforces the upper portion of the door against outward movement.

30 Claims, 6 Drawing Sheets

RAIL CAR END ASSEMBLY

This application is a continuation, division, of application Ser. No. 07/065,948, filed Jun. 24, 1987, now abandoned.

BACKGROUND OF THE INVENTION

1. Field of the Invention

This invention pertains to rail car end closures protecting the car against unauthorized entry and undesirable movement of objects contained in the car, and more particularly relates to a two door arrangement of the end closure.

2. Description of the Prior Art

The prior art is replete with various end closures for a railway car. For example, U.S. Pat. No. 3,995,563 discloses an end closure comprising two sliding doors which move between closed and open positions. Upon opening of the doors, each door moves into an open space on the outer side of the rail car through a vertical opening in the side wall. Each door includes an arcuate laterally outer portion and a straight laterally inner portion attached tangent to the laterally inner edge of the arcuate portion. Each door is supported to ride on an arcuate track having the same radius of curvature as the arcuate portion of the door. The door is supported on the track by rollers attached solely to the arcuate portion.

The opening in the side wall provides an undesirable degree of access to the interior of the rail car from outside, placing the contents of the rail car in jeopardy of damage from vandalism and other outside forces. In addition, support of the door on rollers only on the arcuate portion results in a relatively weak support of the laterally inward portions of the doors.

The extension of the door through the side wall presents problems with respect to support of the required ladder at the end of the car. In the prior art, the ladder is supported by a brace beam connected to its top end. Because the door is taller than the height of the brace beam, a slot is cut in the door to allow it to open. This slot weakens the laterally outward upper corner of the door, which may be bent back to gain access to the interior of the car.

SUMMARY OF THE INVENTION

The subject invention eliminates movement through vertical opening in the side wall. The arcuate portion of the door is also eliminated. The assembly provides a door stabilizing arrangement via top and bottom tracks, and also provides a door locking system.

The rail car end assembly of the present invention comprises a pair of substantially straight and continuous solid side walls, and a pair of multi-panel doors mounted for movement between open and closed positions along top and bottom tracks. When opened, the doors move into the space between the side walls and remain adjacent the side walls in the open position. The doors are substantially coterminous with the side walls in the open position. The top and bottom tracks guide and stabilize the doors in all door positions. Each door moves through a space defined between an end post located inside the car and a side wall end portion offset laterally outwardly from the end post.

DESCRIPTION OF THE PREFERRED EMBODIMENT

Figure 1:
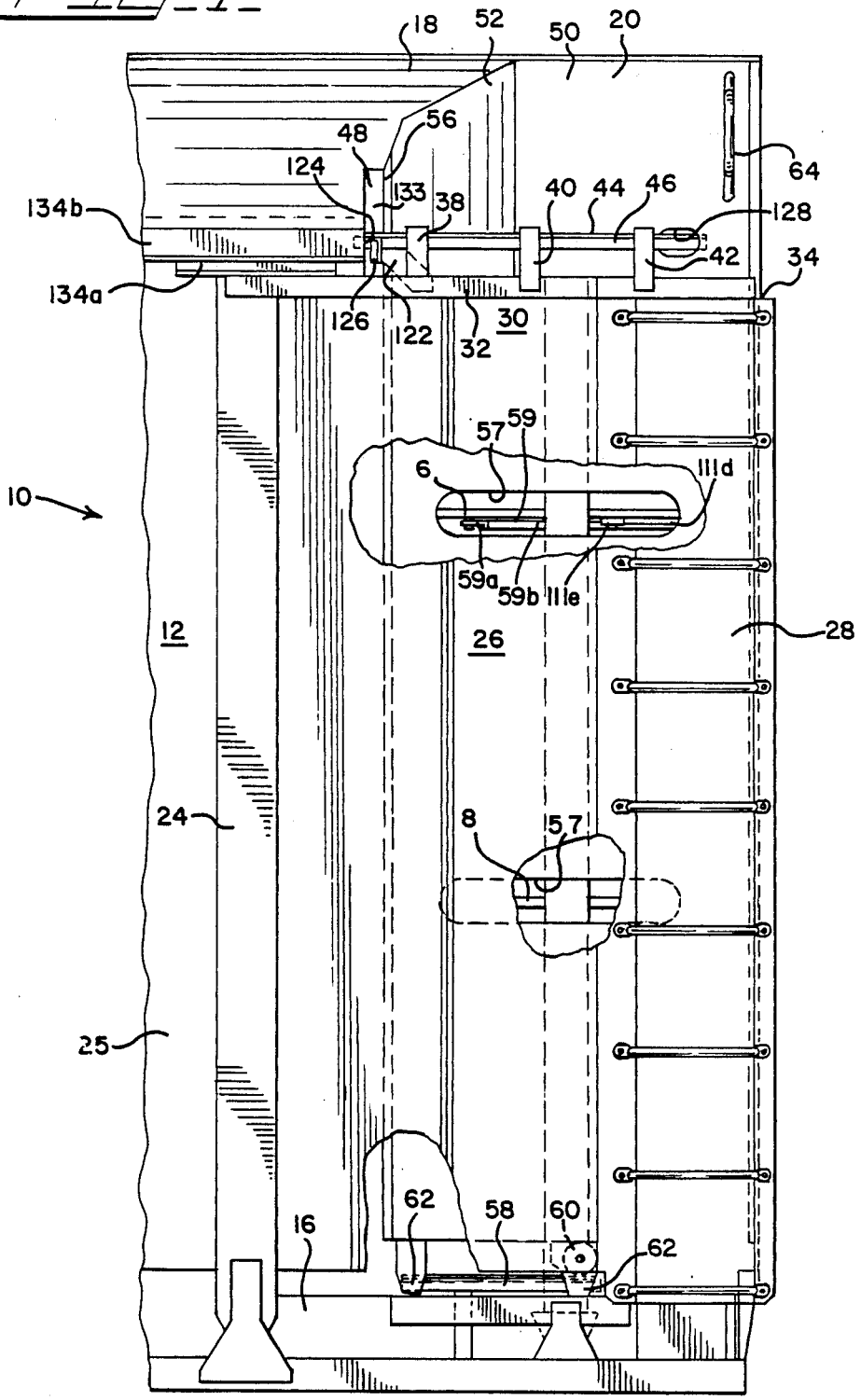
FIG. 1 is a side view of the rail car end assembly of this invention.

Referring to the drawings, wherein reference characters designate corresponding parts throughout the several views, FIGS. 1–7 show a railway car for transporting automobiles on a series of vertically spaced decks 6 and 8. The end assembly generally indicated at 10 comprises a pair of longitudinally extending substantially straight and continuous side walls 12 and 14, a floor 16, a roof 18 and a pair of multi-panel rigid doors 20 and 22. The side wall and door of one side of the railway car are mirror images of those of the other side of the car. Only one side of the end assembly 10 will be described herein, and it will be understood that similar structure is present on the other side of the car.

As shown in FIG. 1, the side wall 12 includes a vertical support post 24. Side wall 12 includes a longitudinally intermediate portion 25 and an end portion 26 connected with the longitudinally outward end thereof. End portion 26 is offset laterally outward from the intermediate portion 25. A ladder 28 is connected to end portion 26 and extends the full height of the wall 12. The ladder 28 enables a worker to climb to the decks 6 and 8. The upper end 30 of the wall end portion 26 is connected with a tubular bar 32 extending from the post 24, above end portion 26 and to the outer edge 34 of the car. Angle-shaped brackets 38, 40 and 42 are mounted on the tubular bar 32 and support an upper track 44. The upper track 44 is angle-shaped in cross section and has a depending flange 46. Upper track 44 is also attached at its longitudinally inner end to a roof supporting structure 48.

In the closed position (see FIGS. 2 and 5), the doors 20 and 22 span the space between the side walls 12 and 14 to substantially cover the entire opening at the longitudinal end of the car. Each of the doors 20 and 22 shown in FIGS. 1, 2, 4 and 5 includes a laterally inner panel 50 rigidly secured to a laterally outer panel 52 at an obtuse angle. In the preferred embodiment, panels 50 and 52 are angulated at approximately 150 degrees with respect to each other.

Figure 2:
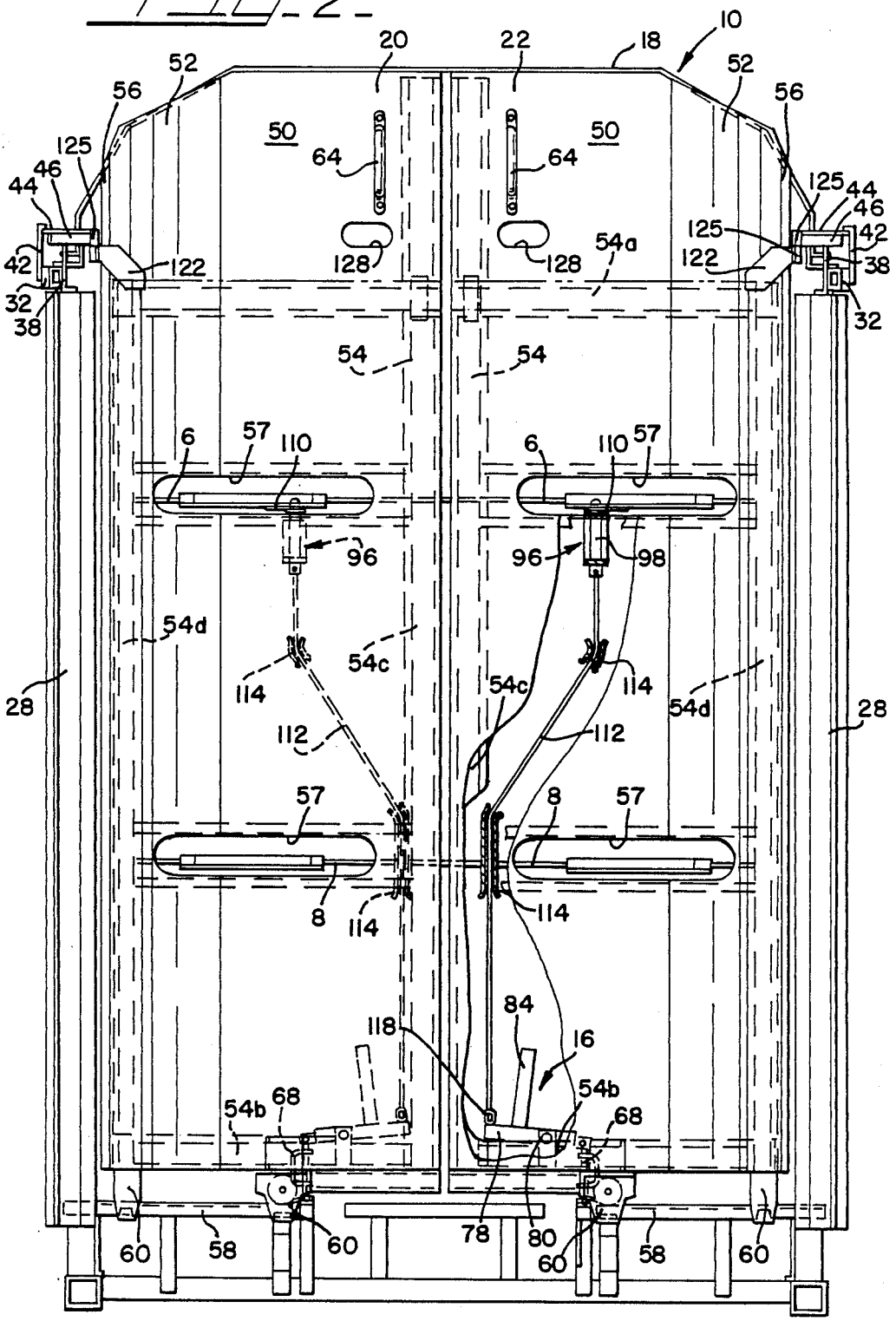
FIG. 2 is a front elevational view of the rail car end assembly.

As best visible in FIG. 2, the doors 20 and 22 are primarily reinforced by door frame 54. Door frame 54 includes upper and lower hat shaped reinforcement members **54*a* and 54*b* each being angled for attachment to inner and outer panels 50 and 52. Door frame 54 also includes vertical reinforcement members 54c and 54d connected with the inside surfaces of inner panel 50 and outer panel 52 respectively adjacent the edges of the door 20. Vertical reinforcement members 54c extend substantially the height of the door 20**.

For additional reinforcement of the door 20, an angled flange 56 is provided along the laterally outer edge of outer panel 52. Each of the doors 20 and 22 has a pair of horizontal slots 57 therein which accommodate the ends of bridge plates of parallel decks 6 and 8 which extend partially through the doors 20 and 22.

The doors 20 and 22 ride between open (FIGS. 1 and 4) and closed (FIGS. 2 and 5) positions along respective arcuate bottom tracks 58 and respective arcuate upper tracks 44. Arms 59 are pivotally connected with deck 6 and with vertical members 54c to additonally guide the doors 20 and 22 in movement along tracks 58 and 44. Arm 59 has a plate portion 59a pivotally supported on platform 6. Plate portion 59a extends generally outwardly from the pivotal connection to plateform 6. Arm portion 59b is connected with the lower surface of plate portion 59a to provide industry standard clearance above platform 8.

Each panel 50 and 52 has a roller assembly 60 depending from the bottom edge of the panel and riding on the bottom track 58. The roller assemblies 60 each include a generally J-shaped member 62 guiding the doors 20 and 22 along the tracks 58 and preventing the door from lifting up or moving laterally a substantial distance from the track 58.

A handle 64 is mounted on the outer surface of the inner panel 50 near the top thereof. When the doors 20 and 22 are moved to the open position, handle 64 is in a position to be reached directly above the top rung of ladder 28, and may be used by an operator for balance in movement from the ladder 28 to the upper deck 6.

Figure 3:
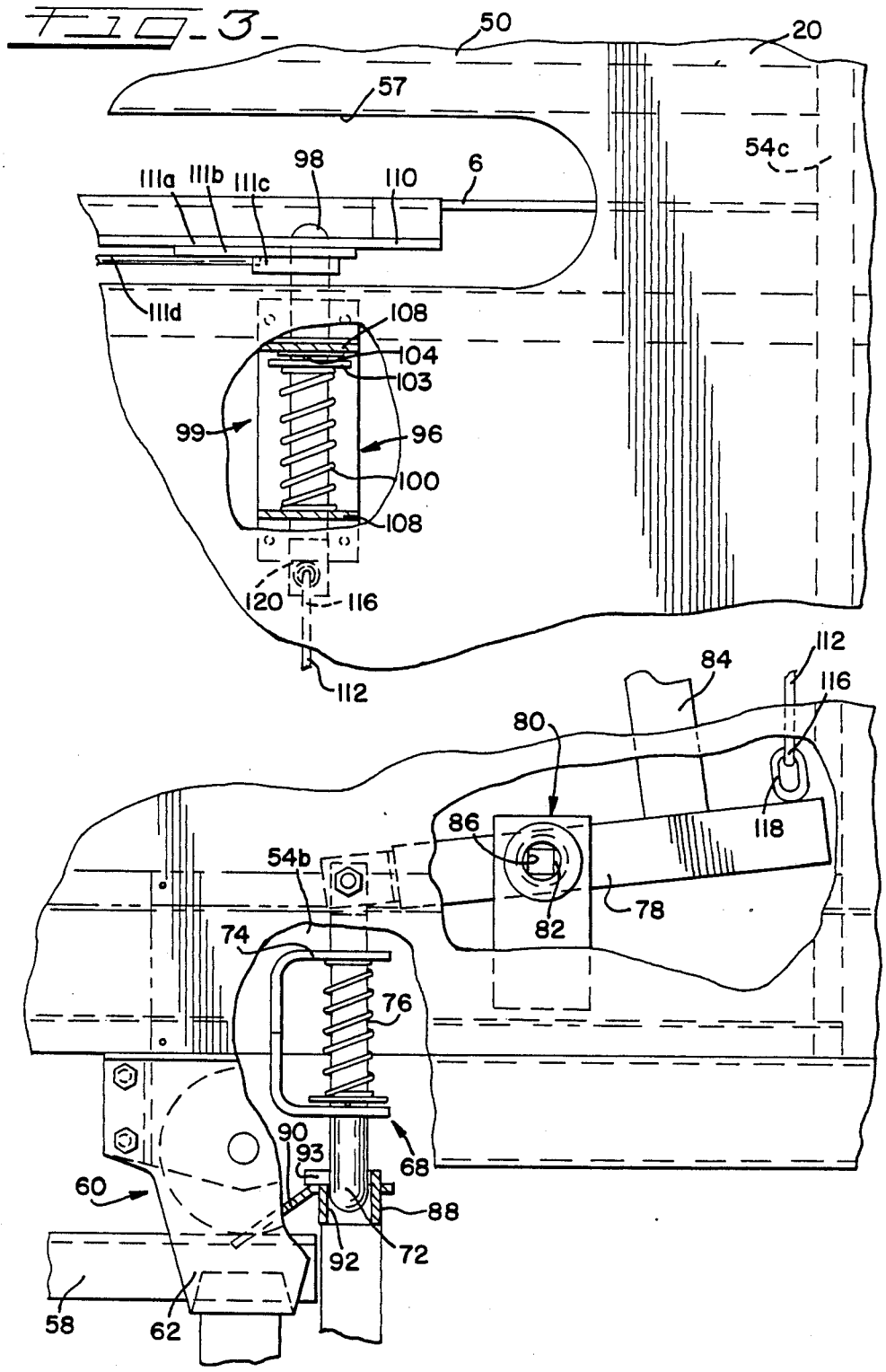
FIG. 3 is a break away view of the door lock mechanism of the end assembly.
Figure 4:
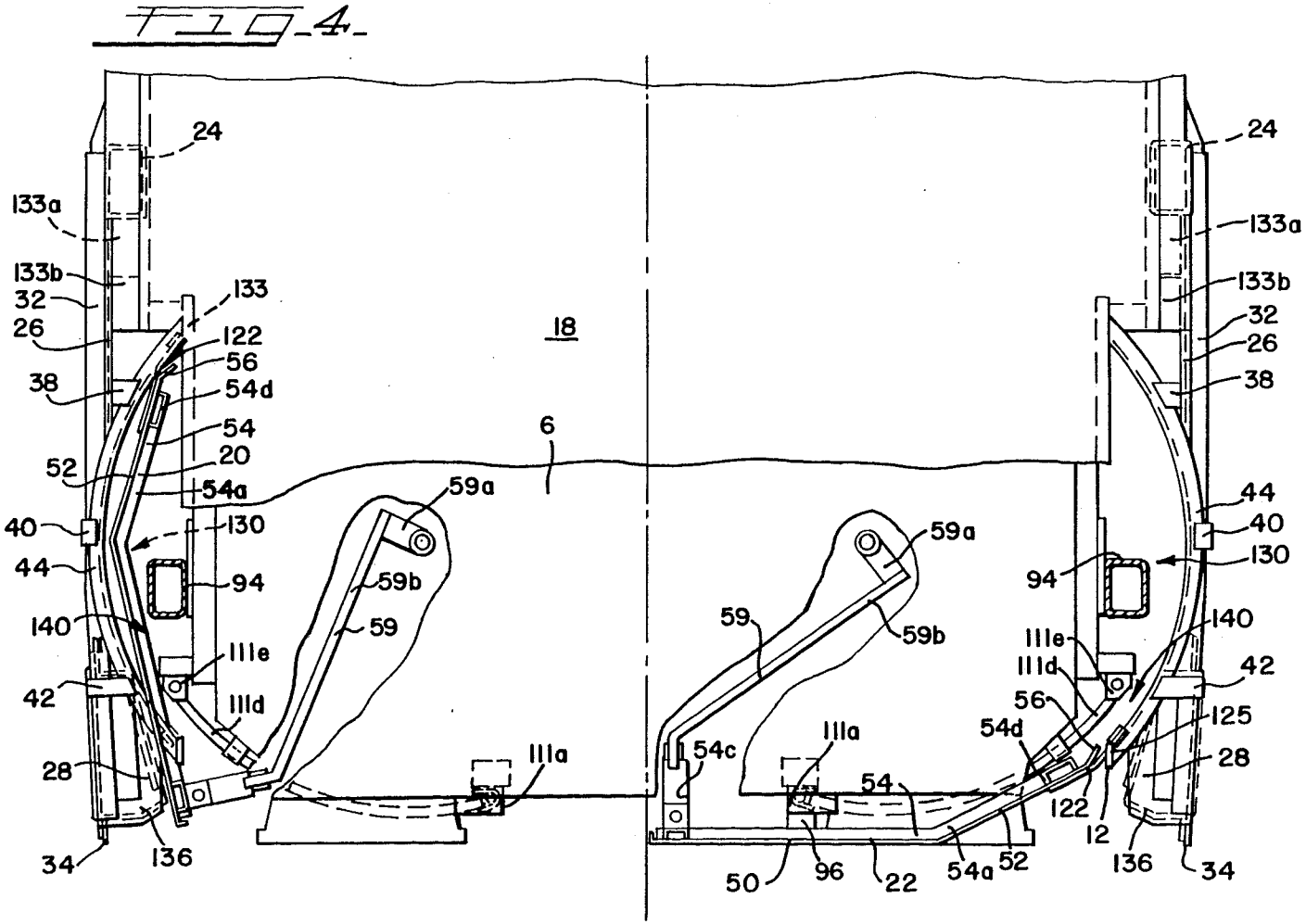
FIG. 4 is a top view of the assembly showing the upper tracks with one door open and one door closed.

As best shown in FIG. 3, a lock mechanism 66 secures the door in closed and open positions. The lock mechanism 66 includes a bottom lock 68 attached to the inner side of the inner panel near the inner panel roller assembly 60. The bottom lock 68 has a spring-loaded bottom pin 72 movably supported extending through the generally parallel walls of a channel-shaped member 74. Channel member 74 is rigidly secured to the inner door panel 50 and houses a compression coil spring 76 which biases the pin 72 to move downwardly. The pin 72 is pivotally connected to a lever 78 at pivotal connection 80. Lever 78 is rotatable about the shaft 82, which projects from the inner door panels 50. Pin 72 may be manually moved upwardly when the door 20 is open, by rotation of lever 78 by moving handle 84 downward. When the door 20 is closed, the lever 78 may be rotated to raise pin 72 by rotation of a crank (not shown) which is inserted into socket 86 mounted on lever 78.

Figure 5:
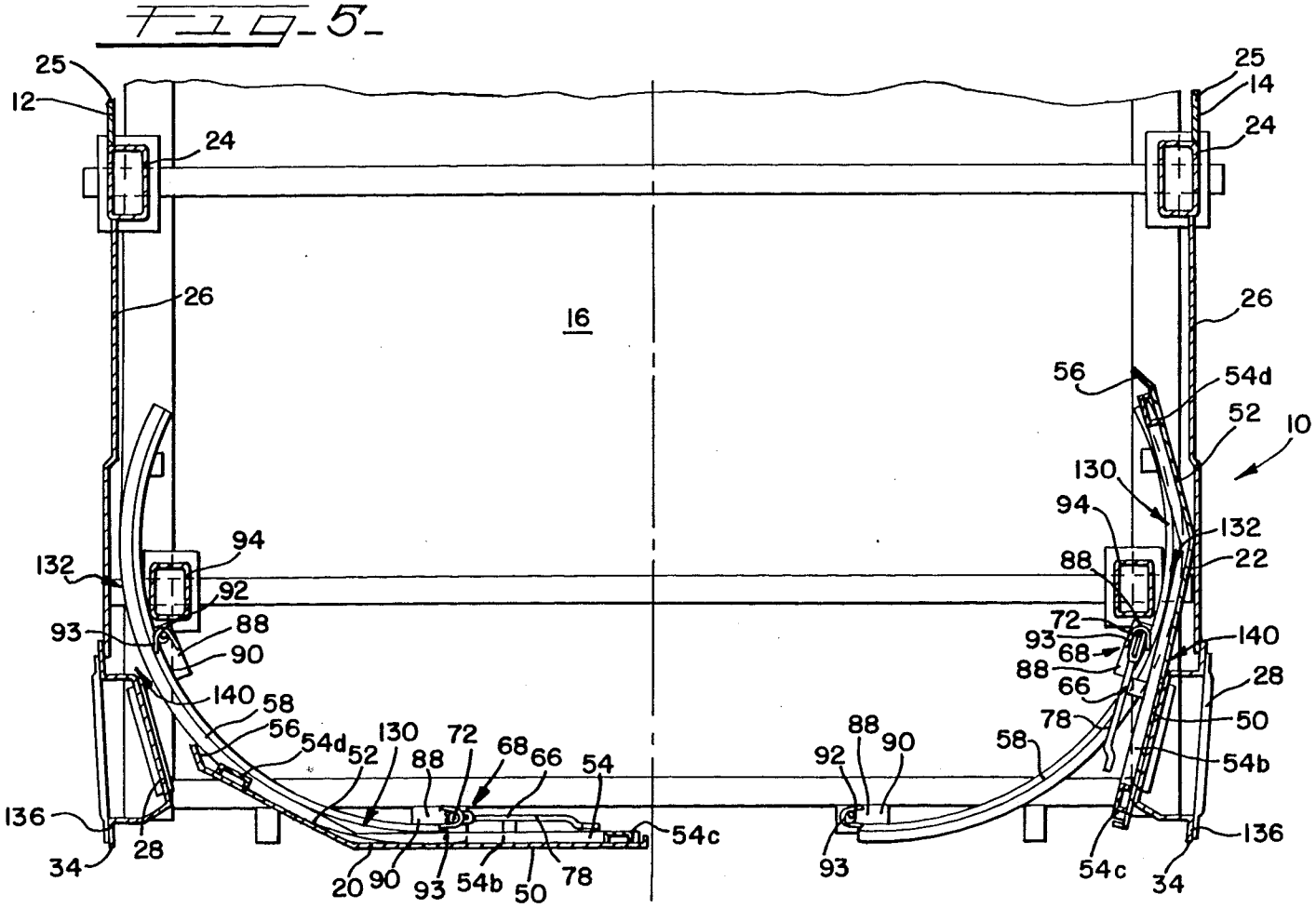
FIG. 5 is a top view of the assembly showing the doors in open and closed positions.

As best visible in FIG. 5, during movement of the door 20 between open and closed positions, the bottom pin 72 is carried on the door adjacent the bottom track 58 until it contacts one of two floor-mounted keepers 88 provided for each door. Each keeper includes an upwardly sloping metal ramp 90 which guides the pin 72 to a pin well 92. A protective collar 93 surrounds the well 92. The pin 72 drops into the well 92 and thereby retains the door in a fixed position. The keepers 88 can be located at desired locations. In the subject embodiment, the keepers 88 are located near the vertical end posts 94 and at the laterally inward end of each bottom track 58. Intermediate the keepers 88, pins 72 are carried spaced radially inward from the arcuate track 58 and have no contact with any part of the car except the door, thereby avoiding friction during movement of the door between the open and closed positions.

An upper lock 96 of the lock mechanism 66 secures the door to the upper deck 6. The upper or platform lock 96 includes a vertical pin 98 supported for vertical movement on a structure 99 mounted on the door. Pin 98 is biased to move upwardly by a compression coil spring 100 through which the pin 98 extends. The structure 99 carrying the pin 98 includes a pair of spaced generally horizontal flanges 108 having openings therein receiving pin 98. Spring 100 engages the lower flange 108 and supports plate 103 secured against upward movement with respect to pin 98 by securement pin 104. A platform keeper structure generally indicated at 110 is supported on the platform 6, to retain the pin 98, when the door is closed, thereby fixing the door against movement. Keeper structure 110 includes mounting portion 111a mounted on the platform 6. Plate 111b is affixed to the lower surface of mounting portion 111a. Both mounting portion 111a and plate 111b have openings therein receiving pin 98 when the door is locked in the closed position. Guide 111c is similar in structure to guide 93 on the lower keeper 88, and is fixed on the lower surface of plate 111b to guide pin 98 to the opening therein as the door is moved to the closed position.

Arcuate track 111d is connected with plate 111b and platform 6. Track 111d provides a downward facing surface in which pin 98 rides during movement of the door between the open and closed postions. The outer end of track 111d is connected with keeper plate 111e which receives pin 98 for locking the door in the open position.

Both top and bottom locks are connected by a flexible link or a cable 112 running through guides 114. The cable 112 has eyelets 116 secured to a ring 118 on lever 78 and in an aperture 120 in upper locking pin 98.

As the door is moved into the closed position, lower lock pin 72 contacts the ramp 90 of lower keeper 88. As the door continues to move, the ramp 90 cammingly elevates lower lock pin 72. The elevation of lower lock pin 72 is transmitted through pivot 80 to lever 78, which is rotated in a clockwise direction about shaft 82. This rotation draws ring 118 downward along with cable 112. Cable 112 draws upper lock pin 98 downward, allowing pin 98 to pass below plate 111b. When lower lock pin 72 reaches the opening in keeper 88, the biasing force of spring 76 moves lower lock pin 72 downward into the opening in keeper 88, and upper lock pin 98 is raised by spring 100 to enter the opening in upper keeper structure 110.

The keeper 88 at outward end of bottom track 58 functions similarly to keeper 88 at the inward end of the track, and serves to latch the door in the open position. The downward locking movement of lower lock pin 72 is comtemporaneous with the upward locking movement of the upper lock pin 98 entering the opening keeper plate 111e, additionally securing the door in the open position.

During the movement of the door, the door panels 50 and 52 define a rigidifying apex or ridge therebetween directed toward the tracks and follow the path of the bottom tracks 58. Both panels are guided by respective rollers riding on these tracks. The upper portions of the doors 20 and 22 are stabilized by upper tracks 44 guiding the follower or yoke 122, fixedly attached to the outer flange 56 of the associated door.

Figure 6:
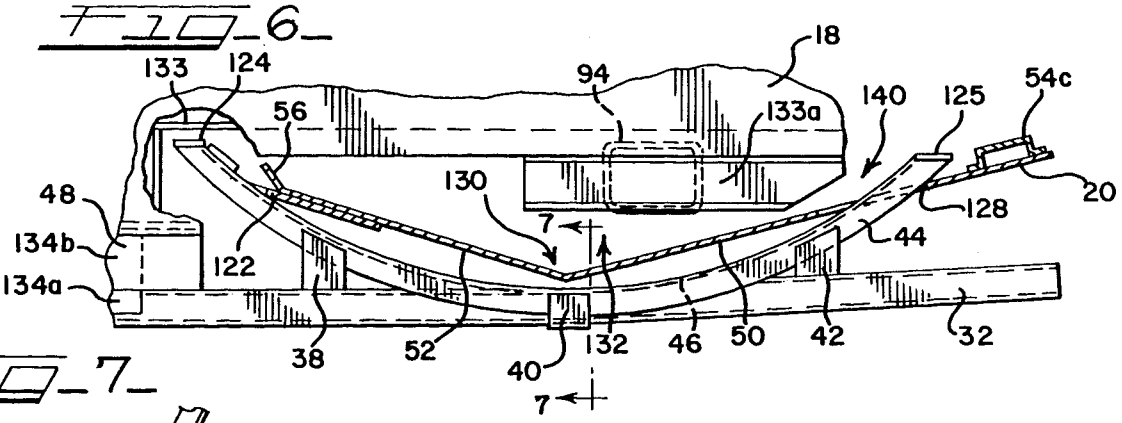
FIG. 6 is an enlarged view as in FIG. 4 showing the upper track structure.

The upper track 44, best shown in FIG. 6, is an arcuate portion of a circle and has inner and outer end stops 124 and 125, respectively, preventing movement of the yoke 122 beyond the ends of track 44.

Figure 7:
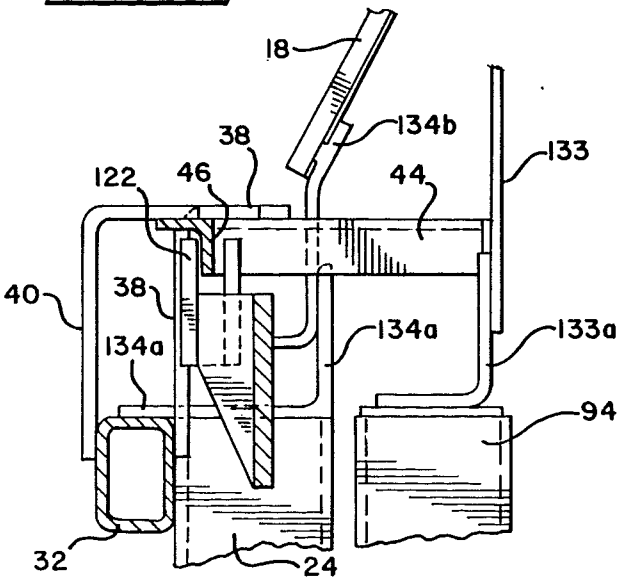
FIG. 7 is a cross-sectional view of the upper track taken along the line A-A in FIG. 7 and showing the yoke on the door at an intermediate location on the track.

As best visible in FIGS. 6 and 7, yoke 122 includes a pair of spaced lugs 126 receiving therebetween the downwardly depending flange 46 of track 44. When the door is closed, yoke 122 engages outer stop 125, and this braces the upper portion of the associated door against movement outwardly of the car.

When the door is opened, yoke 122 engages inner stop 124 to limit movment of the door beyond that point. Door inner panel 50 has a clearance opening 128 therein which receives the outward end of the upper track 44 to permit the door to be moved to fully uncover the end opening of the car.

When the door is open, the vertical end post 94 is within the inward facing recess or V-shaped space generally indicated at 130 defined by the door panels 50 and 52. The door swings around and bypasses this post 94 during movement between open and closed positions. The door moves within the space 132 defined by the vertical end post 94 and the side wall end portion 26. The location of the vertical posts 94 inwardly of the side walls allows for the movement of the door within the car and without undesirable openings in the side walls 12 and 14, while still complying with industry standards for lateral space in the car between the vertical posts 94 and also limits on the lateral width of the car.

As best shown in FIGS. 4, 6, 7 and 8, roof supporting structure 48 includes a longitudinally extending wall 133 connected with the roof of the car and with angle member 133*a* supported on vertical post 94. Post 24 supports angle member 134*a* secured in engagement with roof angle member 134*b*.

The doors and side walls are substantially coterminous with the outer edge 34 of the car. The corner structure 136 supports the ladder 28 and buttresses the car end structure. The door moves through the space 140 defined between the corner structure 136 and the end post 94 located inside the car until it reaches its fully open position determined by the bottom lock engagement with the floor-mounted keeper 88 and the yoke 122 abutment against the upper track end stop 125.

One of the advantages of the subject assembly is that the continuous side walls reinforce structural integrity of the car and offer greater protection from unauthorized entry than cars with openings in the side wall. Also, such walls prevent undesirable entry of dirt, mud and precipitation into the car. Also, the prior art cars having a slot in the side wall required a support bar to pass above the slot to support the longitudinally outer part of the wall. This support bar blocked movement of the upper part of the door. As a result, it was necessary to provide a slot in the door for clearance. This slot considerably weakened the upper door structure. The present invention, by providing for door movement entirely laterally inward of the side wall obviates the need for the clearance slot and results in a much stronger door structure.

Another advantage of the novel end closure is that the upper portion of the door is stabilized during the door movement by the upper track. The end stops of the upper track further improve support of the door in open and closed positions in the closed position, each door is supported at a plurality of points, i.e. the two lower roller assemblies 60, the lower pin 72, the upper pin 98, and the yoke 122 engaging stop 125. Outward movement of the inner edge of the door is also prevented by arm 59.

The above mentioned advantages are achieved without any functional or spatial sacrifice.

Figure 8:
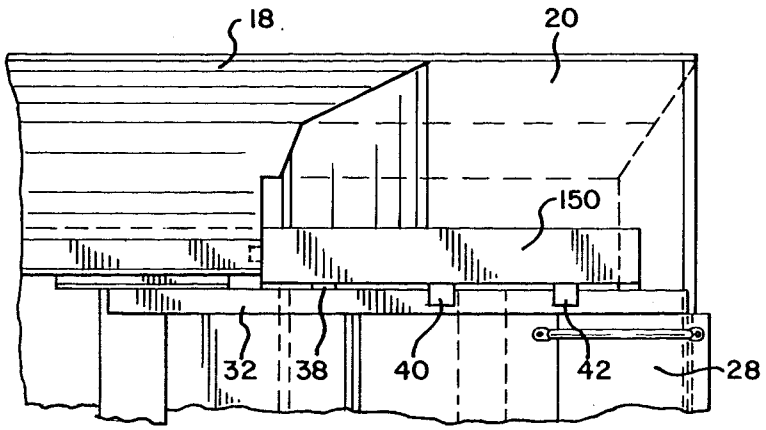
FIG. 8 show an elevational view of an alternate embodiment having a shield plate mounted adjacent the upper track.

The upper part of doors 20 extend vertically through an opening 128 adjacent the upper track 44. As best shown in FIG. 8, to additionally protect the contents of the car against access through this opening when the doors 20 are closed, a shield plate 150 may be secured to the laterally outer surfaces of angles 38, 40, and 42.

The foregoing description and drawings merely illustrate the preferred embodiment and the invention is not limited thereto, except insofar as the appended claims are so limited as those skilled in the art who have the disclosure before them will be able to make modifications and variations therein without departing from the scope of the invention.

What is claimed is:

1. A rail car end assembly comprising:

a pair of substantially straight and continuous side walls defining a space therebetween and having top and bottom arcuate tracks;

a pair of rigid two-panel doors each having two panels for closing the space between the side walls and riding along the top and bottom arcuate tracks between open and closed positions;

said doors in the open position being located between said side walls and, said two panels of each door defining a V-shaped recess for admitting therein and bypassing laterally inward portions of the end assembly as the doors move between closed and open positions.

2. The assembly as in claim 1, and each of said top tracks comprising a generally arcuate rail mounted adjacent a top portion of a respective side wall; and a follower member attached to each of said doors and being guided by a respective track, said panels of each of said doors being flat and joined in an apex directed toward the track.

3. The assembly as in claim 1, and said upper tracks having a pair of end stops thereon, each of said end stops limiting door movement in a respective direction and corresponding to the location of respective doors in said open and closed positions; and said upper tracks being supported by brackets secured to said side walls.

4. A rail car end assembly comprising:

a pair of substantially straight and continuous side walls defining a space therebetween and having a top and bottom arcuate tracks;

a pair of rigid doors each comprising a pair of interconnected panels closing the space between the side walls and riding along the top and bottom arcuate tracks between open and closed positions;

said doors int he open position being located between said side walls, and said doors having openings therein located near the top of said doors; and said top tracks projecting through said openings in said doors in said open position.

5. The assembly as in claim 4, and a lock mechanism including a floor-mounted keeper and a spring-load pin mounted on respective doors; and said keeper including a ramp with a pin well.

6. A rail car end assembly comprising:
a pair of substantially straight and continuous side walls defining a space therebetween and having top and bottom arcuate tracks;
a pair of rigid doors closing the space between the side walls and riding along the top and bottom arcuate tracks between open and closed positions;
said doors in the open position being located between said side walls,
and a lock mechanism including a floor-mounted keeper and a spring-loaded pin mounted on said door; and
said keeper including a ramp with a pin wheel, and
said lock mechanism including top and bottom locks synchronously securing said doors int he open position and synchronously securing the doors in the closed position;
said car having at least one deck with a lock keeper cooperating with said top lock for securing an upper portion of the door.

7. A railway car end assembly comprising:
a pair of substantially straight side walls each terminating in an end structure;
a pair of upper tracks and a pair of lower tracks supported on the end structures;
a pair of doors riding along respective upper and lower tracks between open and closed positions;
each of said doors comprising an inner panel secured to an outer panel at an angle;
said inner panels being disposed adjacent to each other in said closed position;
said doors following the path of said lower tracks during movement between said open and closed positions;
said outer panels each having a follower engageable with a respective upper track for guiding and stabilizing said doors;
said inner panels each having an opening therein; and
said upper tracks each projecting through a respective opening when the doors are in the open position.

8. The assembly as in claim 7, and
said follower comprising a yoke attached to an outer portion of said outer panel;
said upper track including a rail mounted adjacent the top of said side wall; and
said upper tracks having end stops for fixation and stabilization of said doors in the open and closed positions.

9. The assembly as in claim 7, and
at least one roller assembly depending from each of said panels for guiding said doors along said lower tracks.

10. The assembly as in claim 9, and
a self-locking mechanism securing said doors in said open and closed positions;
said mechanism including
a spring-loaded pin supported adjacent one of said roller assemblies; and
a floor-mounted keeper including a ramp portion and a pin well portion fittingly receiving said pin; and
a lever mounted on said door and connected with said pin for disengagement of said pin from said keeper.

11. A rail car end assembly having an outer edge and comprising:
a substantially straight and continuous side wall;
a continuous end portion of said side wall being offset laterally outwardly from said wall;
vertical support post located near said offset;
an end post spaced apart from said side wall end portion and said outer edge of the car;
a door including a pair of angularly related interconnected panels forming a stiff ridge interconnected at an obtuse angle;
said door being movable between said end post and said side wall end portion; and
said door in the open position terminating adjacent said outer edge of the car.

12. The assembly as in claim 11, and
said end post being disposed within the space defined by said panels when the door is in the open position,
said panels arranged at such an angle to each other as to circumvent said support post upon closing and opening.

13. The assembly as in claim 11, and
a roof structure connecting with said end post and said support post; and
said door being juxtaposed to said side wall end portion in said open position.

14. The assembly as in claim 11, and
an upper track being connected with said support post.

15. A railway car having a pair of longitudinal ends and comprising:
a generally horizontal floor structure;
first and second laterally spaced generally longitudinally extending side walls connected with the floor structure and extending generally upwardly therefrom;
said side walls extending substantially continuously between the ends of the car and defining an end opening therebetween at one of the ends of the railway car;
a generally vertical support post supported on said floor structure adjacent one of said side walls;
said support post being positioned laterally inwardly from said side wall and longitudinally inward form the end of the car, said support post and said side wall defining a door-admitting space therebetween;
first guiding means supported on the floor structure and extending within said space;
a door moveably supported on the first guiding means for movement between a closed position covering a portion of the opening and an open position wherein the door is positioned within the space between the support post and said one of the side walls, the railway car having substantially continuous side walls permitting the placement of the door laterally outwardly of the support post when the door is in the open position, and
synchronously operative locks on the door in guided engagement with respective guiding means during movements of the door between open and closed positions to simultaneously lock the upper and lower ends of the door attendant to positioning of the doors in closed position.

16. A railway car having longitudinal ends and comprising:
a generally horizontal floor structure;
first and second laterally spaced generally longitudinally extending side walls connected with the floor structure and extending generally upwardly therefrom;
said side walls extending substantially continuously between the ends of the car and defining an end opening therebetween at one of the ends of the railway car;

generally vertical support posts supported on said floor structure adjacent said side walls;

said support posts being positioned laterally inwardly from respective side wall and longitudinally inward from the end of the car, said support posts and respective side wall defining a dooradmitting spaces therebetween;

first guiding means supported on the floor structure and extending within said spaces;

a door moveably supported on the first guiding means for movement between a closed position covering a portion of the opening and an open position wherein the door is positioned within a space between the respective support post and said one of the side walls, the railway car having substantially continuous side walls permitting the placement of the door laterally outwardly of the support post when the door is int he open position, and synchronously operative locks on the door to simultaneously lock the upper and lower ends of the doors attendant to positioning of the doors in closed position, a roof structure being supported on the side walls and having a wall portion connected wit the upper end of said support posts and extending generally upwardly therefrom;

said wall portion being positioned laterally form the respective side walls and defining therewith a generally longitudinally extending opening connecting with the end opening;

said door being one piece and extending generally upwardly through said opening when the door is in closed position.

17. The invention according to claim 16 and the side walls having an upper terminal end portion; and the wall portion of the roof structure extending downwardly to approximately the height of the upper terminal end portion to restrict access to the interior of the car through the longitudinal extending opening when the door is in the closed position.

18. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the ends of the railway car;

a generally vertical support post supported on said floor structure adjacent one of said side walls;

said support post being positioned laterally inwardly from said side wall and longitudinally inward form the end of the car, said support post and said side wall defining a door-admitting space therebetween;

first guiding means supported on the floor structure and extending within said space;

a door moveably supported on the first guiding means for movement between a closed position covering a portion of the opening and an open position wherein the door is positioned within the space between the support post and said one of the side walls whereby the railway car has substantially continuous side walls permitting the placement of the door laterally outward of the support post when the door is in the open position, and and a roof structure being supported on the side walls and having a wall portion connected with the upper end of the support post and extending generally upwardly therefrom;

said wall portion being positioned laterally form the side wall and defining therewith a generally longitudinally extending opening connecting with the end opening;

said door extending generally upwardly through said opening when the door is in closed position and the side wall having an upper terminal end portion; and the wall portion of the roof structure extending downwardly to approximately the height of the upper terminal end portion to restrict access to the interior of the car through the longitudinal extending opening when the door is in the closed position, and a shield member supported adjacent the opening on the upper terminal end portion of the side wall and extending upwardly therefrom to additionally restrict access to the interior of the car.

19. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the ends of the railway car;

a generally vertical support post supported on said floor structure adjacent one of said side walls;

said support post being positioned laterally inwardly from said side wall and longitudinally inward form the end of the car, said support post and said side wall defining a door-admitting space therebetween;

first guiding means supported on the floor structure and extending within said space;

a door moveably supported on the first guiding means for movement between a closed position covering a portion of the opening and an open position wherein the door is positioned within the space between the support post and said one of the side walls, the railway car having substantially continuous side walls permitting the placement of the door laterally outwardly of the support post when the door is in the open position, and synchronously operative locks on the door to simultaneously lock the upper and lower ends of the doors attendant to positioning of the doors in closed position, and said guiding means having a stop structure hereon, a follower structure engaging the stop structure when the door is moved to the closed position for limiting movement of the door beyond the closed position, said guiding means being positioned for reinforcing the door against being torn away from the car in the closed position.

20. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the end of the railway car;

a generally vertical support post supported on said floor structure adjacent one of said side walls;

said support post being positioned laterally inwardly from said side wall and longitudinally inward from the end of the car, said support post and said side wall defining a door-admitting space therebetween;

first guiding means supported on the floor structure and extending within said space;

a door moveably supported on the first guiding means for movement between a closed position covering a portion of the opening and an open position wherein the door is positioned within the space between the support post and said one of the side walls whereby the railway car has substantially continuous side walls permitting the placement of the door laterally outward of the support post when the door is in the open position, and a track supported on the car above the first guiding means; and a follower structure supported on the door and engaging the track for guiding the door in movement between the open and closed positions, said door having a clearance opening therein, and said track extending within said clearance opening when the door is moved to the open position.

21. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the ends of the railway car;

a generally vertical support post supported on said floor structure adjacent one of said side walls;

said support post being positioned laterally inwardly from said side wall and longitudinally inward from the end of the car, said support post and said side wall defining a door admitting space therebetween;

first guiding means supported on the floor structure and extending within said space;

a door moveably supported on the first guiding means for movement between a closed position covering a portion of the opening and an open position wherein the door is positioned within the space between the support post and said one of the side walls, the railway car having substantially continuous side walls permitting the placement of the door laterally outwardly of the support post when the door is in the open position, and a locking mechanism for securing the door in the closed position, said locking mechanism having portions guided on said guiding means and comprising a first lower keeper structure supported on the floor structure; and a first latch structure supported on the door and supporting a first latch member therein;

the keeper structure receiving the latch member therein for securing the door int he closed position, and the locking mechanism further comprising a first upper keeper structure supported on the car; and an upper latch structure being supported on the door and including an upper latch member;

means operatively interconnecting said latch members for automatic conjunctive operation including the upper keeper structure receiving the upper latch member contemporaneously with the first lower keeper structure receiving the first latch member when the door is moved to the closed position for additionally securing the door.

22. The invention according to claim 21 and a second upper keeper structure receiving the second latch structure when the door is in the open position.

23. A railway car having a pair of longitudinal ends and comprising:

a generally horizontal floor structure;

first and second laterally spaced generally longitudinally extending side walls connected with the floor structure and extending generally upwardly therefrom;

said side walls extending substantially continuously between the ends of the car and defining an end opening therebetween at one of the ends of the railway car;

a generally vertical support post supported on said floor structure adjacent one of said side walls;

said support post being positioned laterally inwardly from said side wall and longitudinally inward from the end of the car, said support post and said side wall defining a door admitting space therebetween;

first guiding means supported on the floor structure and extending within said space;

a door moveably supported on the first guiding means for movement between a closed position covering a portion of the opening and an open position wherein the door is positioned within the space between the support post and said one of the side walls, the railway car having substantially continuous side walls permitting the placement of the door laterally outwardly of the support post when the door is in the open position, and a locking mechanism for securing the door in the closed position, said locking mechanism comprising a first lower keeper structure supported on the floor structure; and a first latch structure supported on the door and supporting a first latch member therein;

the keeper structure receiving the latch member therein for securing the door in the closed position, the locking mechanism further comprising a first upper keeper structure supported on the car; and an upper latch structure being supported on the door and including an upper latch member;

the upper keeper structure receiving the upper latch member contemporaneously with the first lower keeper structure receiving the first latch member when the door is moved to the closed position for additionally securing the door, and a second upper keeper structure receiving the second latch structure when the door is in the open position, and a track member connecting the first and second upper keeper members.

24. The invention according to claim 23, and said upper latch structure having biasing means urging said upper latch member upwardly; and said upper latch member engaging the track member during movement of the door between the open and closed positions.

25. The invention according to claim 15, and an upper and lower latch structures supported on the door;

upper and lower laterally inward keeper structures supported on the car;

means operatatively connecting said upper and lower latch structures for coacting substantially synchronously with the upper and lower laterally inward keeper structures respectively to secure the door in the closed position;

upper and lower laterally outward keeper structures supported on the car;

said upper and lower latch structures coacting with said upper and lower laterally outward keeper structures when the door is in the open position to secure the door in said open position.

26. A railway car comprising:

a generally horizontal floor structure having a longitudinal end;

a side wall structure extending generally upwardly from the floor structure;

said side wall structure having an upper terminal end;

canopy structure supported on the side wall structure, said canopy structure including a side wall connection portion being connected with the upper terminal end of the side wall structure, and extending generally upwardly and laterally inwardly therefrom;

said canopy structure further including an inset portion connected with the side wall connection portion and extending generally longitudinally outwardly therefrom, said inset portion being spaced laterally inwardly from the upper terminal end of the side wall structure;

said inset portion and the upper terminal end of the side wall structure defining a space therebetween;

the floor structure, the side wall structure, and the canopy structure defining an opening therebetween adjacent the longitudinal end of the floor structure for providing access to the interior of the car for placing articles therein to be transported;

a door moveably supported on the car;

guide means for guiding the door in movement between a closed position and an open position;

said door in the closed position extending over said opening to restrict access to the interior of the car;

said door in the closed position extending within the space between the inset portion and the side wall structure, and said inset portion including a substantially vertical wall portion extending generally parallel to the side wall structure and spaced laterally inwardly therefrom, and a first post supported on the floor structure and extending generally upwardly therefrom;

said post being spaced laterally inwardly from the side wall structure and having a laterally inward end surface;

said post having connection means thereon connected with said inset portion of said canopy for the support thereof, and said post having an upper terminal end portion, and said connection means including a generally angle shaped member having a first generally vertical flange portion connected with the wall portion, and a second generally horizontal flange portion supported on and generally overlying the upper terminal end of the post.

27. The invention according to claim 26 and the laterally inward surface of the post and the vertical wall portion being substantially coplanar in a plane extending generally longitudinally and vertically relative to the car.

28. The invention according to claim 27, and said connection portion of the canopy extending generally diagonally upwardly and laterally inwardly relative to the car whereby the connection portion and the vertical wall portion describe a gap therebetween.

29. A railway car having a pair of longitudinal ends and comprising a generally horizontal floor structure;

first and second laterally spaced longitudinally extending side walls connected with the floor structure and extending generally upward therefrom;

said side walls extending substantially continuously between the ends of the car and defining an end opening at one of the ends of the railway car;

guiding means supported on the floor structure and extending within the end opening;

a door movably supported at its lower end on said guiding means for movement between an open position wherein the door is located alongside an adjacent side wall and a closed position covering said end opening, and a retainer guide arm having an inner end pivotally mounted on the car for swinging movement about a vertical axis and having an outer end pivotally connected on a vertical axis to the upper end of an associated door adjacent to the inboard edge thereof and holding said upper end of the door at said inboard edge secured and preventing it form being torn away, and, second guide means supported within the end opening adjacent the upper end thereof in guiding engagement with the door, and locking means on the door in slidable guided engagement with said guiding means.

30. The invention according to claim 29, and said door comprising a plurality of angularly related panels disposed in mutually stiffening relation to each other.

* * * * *